United States Patent [19]

Miller

[11] 4,020,201

[45] Apr. 26, 1977

[54] ARTIFICIAL TREE

[76] Inventor: Jeanne Marylyn Miller, 3221 W. Colorado Ave., Colorado Springs, Colo. 80904

[22] Filed: Feb. 11, 1976

[21] Appl. No.: 657,042

[52] U.S. Cl. ..... 428/8; 428/20; 240/10 T; 248/27.3

[51] Int. Cl.[2] ..... A47G 33/06

[58] Field of Search ..... 428/7, 17, 18, 19, 20, 428/27, 8–12; 240/10 T, 10 Q, 152; 339/126 R, 157 C; 248/27.1, 27.3; 156/61

[56] References Cited

UNITED STATES PATENTS

| | | | |
|---|---|---|---|
| 1,677,972 | 7/1928 | Marks | 240/10 Q |
| 1,861,151 | 5/1932 | Buschman | 240/52.1 |
| 2,095,648 | 10/1937 | Oftedahl | 240/10 T |
| 2,188,529 | 1/1940 | Corina | 240/10 Q |
| 2,911,748 | 11/1959 | Rodgers | 428/12 X |
| 3,050,891 | 8/1962 | Thomsen et al. | 428/18 X |
| 3,603,780 | 9/1971 | Lu | 428/20 X |
| 3,735,117 | 5/1973 | Hunt | 240/10 T |
| 3,819,459 | 6/1974 | Wren | 428/8 X |

*Primary Examiner*—George F. Lesmes
*Assistant Examiner*—Henry F. Epstein
*Attorney, Agent, or Firm*—W. Britton Moore

[57] ABSTRACT

An artificial tree, such as a Christmas tree, including two hollow trunk members sleeved together and having removable limb sockets angularly disposed in said members. A lighting system comprising wiring is arranged within the trunk members and wiring sockets are disposed within openings in the trunk members adjacent the limb sockets and retained therein by spring clip members arranged in the trunk members opposite to the wiring sockets. Limbs extend outwardly from the limb sockets whereby bulbs and wiring extending from the wiring sockets may be secured thereto. Top and bottom caps are provided on the trunk members and the latter is sleeved over a supporting base.

5 Claims, 4 Drawing Figures

ARTIFICIAL TREE

This invention relates to an artifical tree including upper and lower hollow trunk members removably sleeved together and having a plurality of openings arranged therein for receiving limb and wiring sockets and spring clip members, with the clip members being disposed opposite to and engageable with the wiring sockets to retain the latter in positions adjacent to limbs extending from the limb sockets.

The principal object of the present invention is to provide an improved artifical tree including hollow trunk members sleeved together and having limb and wiring sockets removably arranged within openings therein, with the latter being retained therein by spring clip members.

Another object is the provision of an artifical tree wherein the two sleeved hollow trunk members ae apertured to removably receive limb and wiring sockets.

Still another object is the provision of limb sockets of flexible material with spaced annular flanges thereon for interengaging with the edges of the trunk openings for angularly receiving the limbs therein.

A further object is to provide wiring sockets sleeved within the trunk openings and removably retained therein by bowed spring clips arranged within oppositely disposed trunk openings.

A still further object is to provide an artificial Christmas tree wherein the lighting system wiring is essentially housed and concealed within the trunk members.

These and other objects and advantages will be apparent as the specification is considered with the accompanying drawings, wherein- FIG. 1 is a perspective view of an assembled artificial tree in accordance with my invention;

While various electrically wired artificial Christmas trees have been developed, for example, in U.S. Pat. Nos. 2,101,898; 2,911,748; 3,603,780; and 3,819,459, none of these structures inclue readily assembled hollow sleeved trunk members having wiring and limb sockets removably arranged therein so that the wiring is housed and concealed within the trunk members and the limbs and lighting bulbs are easily assembled thereon.

Figure 2:
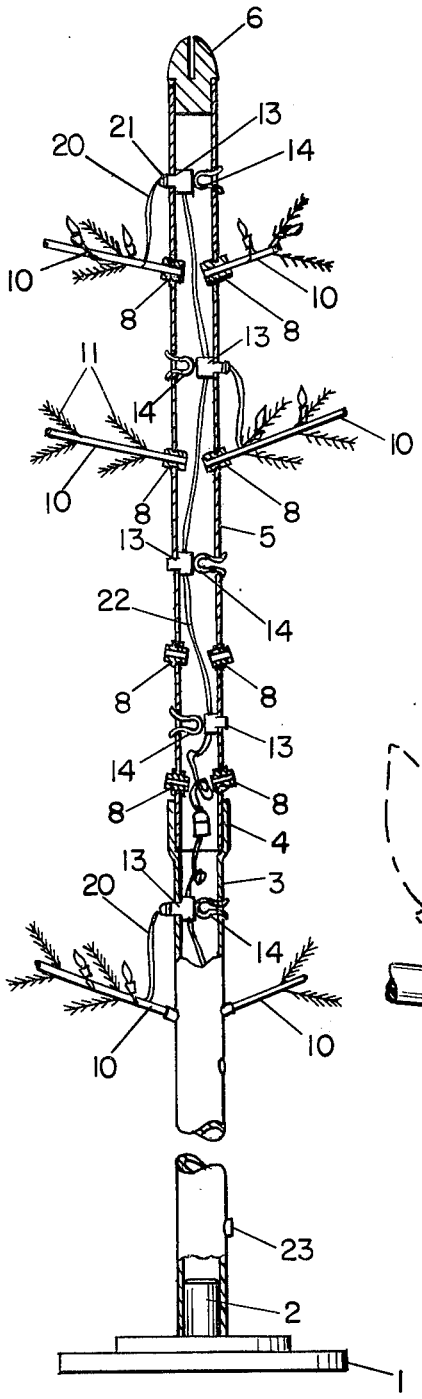
FIG. 2 is a vertical view, partly in section, of the sleeved trunk members, showing the electric wiring housed therein.

Referring more particularly to the drawings, wherein similar reference characters designate like parts throughout the several views, the preferred embodiment includes a flat base 1 having an upstanding centrally arranged stub shaft 2 for receiving the lower end of the tubular hollow lower trunk member 3 thereover, as best shown in FIG. 2. The upper end of member 3 is flared outwardly as at 4, to sleevingly accommodate the lower end of an upper tubular hollow trunk member 5. A tapered closing cap 6 is sleeved within the upper end of member 5. In the alternative, a separate closing plug, not shown, may also be inserted in the lower end of trunk member 3, in which case the plug could be bored to received a post on base 1.

Figure 3:
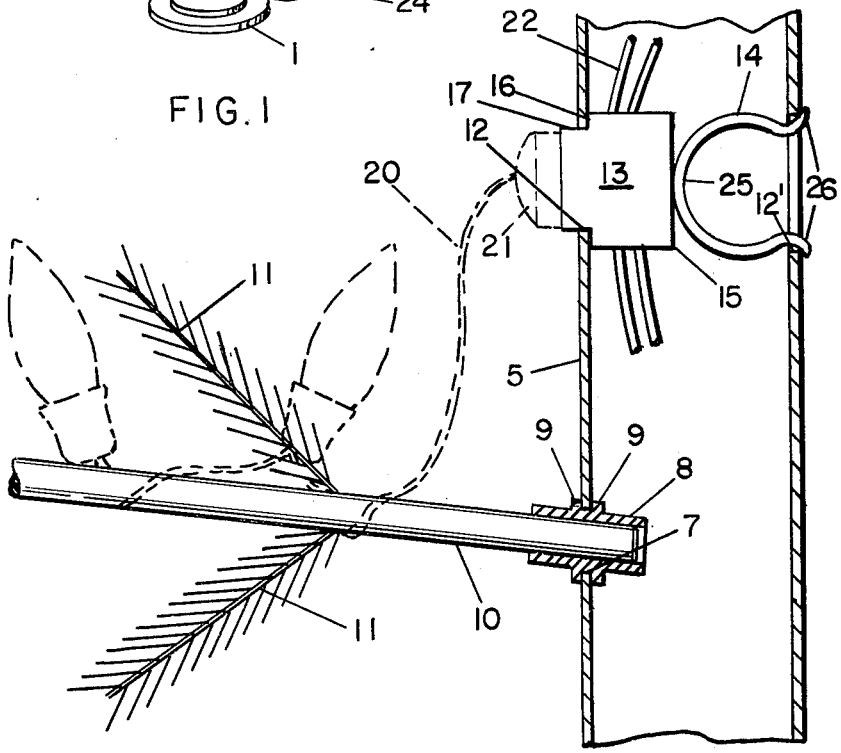
FIG. 3 is an enlarged view, partly in section, of a trunk member, showing a wiring socket and a spring holding clip, a limb socket and limb therein, and the wiring extending from the wiring socket with a bulb arranged on the limb.

A plurality of apertures 7 are angularly formed at suitably aligned spaced intervals in and around trunk members 3 and 5 and receive cylindrical limb sockets 8 therein, with spaced annular flanges 9 on each of the sockets snugly embracing the rim of each aperture, as best shown in FIG. 3. The sockets are of some suitable flexible material, such as rubber or plastic, to enable each socket to be inserted through each aperture, with the flanges flexing past the aperture rims and the ends of the sockets projecting outwardly and inwardly of the trunks. This facilitates assembly and disassembly and securely retains the sockets within the apertures. Artificial limbs 10 having branches 11 extending outwardly therefrom are sleeved within each of the apertures 7 and are preferably formed of suitable flexible plastic material made to simulate the branches of a tree.

Figure 4:
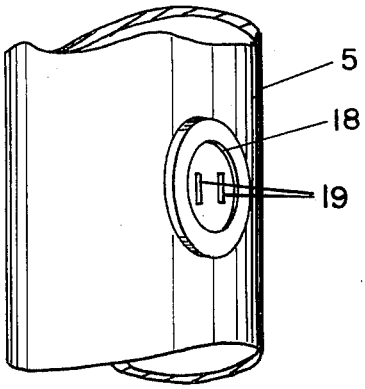
FIG. 4 is a portion of a trunk member with a wiring socket disposed therein.

Formed in the trunk members 3–5 adjacent but spaced from limb socket apertures 7 are oppositely aligned apertures 12—12′ for receiving tubular female electrical connectors 13 and spring retainer clips 14. The base 15 of each connector is arranged in a trunk member and the base is inset to provide a flat face 16 and reduced tubular end portion 17 so that when inserted through and opening 12′, face 16 will flatly engage the inner wall of a trunk member and assist in positioning the connector therein. A plate 18 (FIG. 4) on the outer end of each reduced portion 17 is provided with the usual slotted openings 19 to enable a conventional male electrical plug 21 on a conventional double string of miniature lights 20 to be plugged thereinto in an obvious manner. Each female connector 13 is connected at its base to a main double conductor wire 22 extending lengthwise of trunk members 3–5, and the lower end thereof projects through an opening 23 in lower trunk member 3 and is provided with a conventional male electrical plug 24 for connection to any suitable source of current, not shown.

Each retainer clip 14 has a bowed base portion 25 terminating in spaced outwardly and oppositely bent ends 26. After the female connectors 13 and the main conductor wires 22 have been inserted within the hollow trunk members and positioned within apertures 12, the bent ends 26 of each of the clips 14 may be squeezed together to reduce the width of the bowed base 25 and enable it to be inserted inwardly through an aperture 12′, opposite to that in which connector 13 is arranged, whereupon release of pressure from the ends will expand the base beyond the diameter of the opening and cause the ends 26 to engage with the lip on the aperture 12′ and retain the clip therein, as best shown in FIG. 3. When so assembled, the spring bowed base 25 will engage and bear against base 15 of connector 13 and prevent the latter from being dislodged from its aperture 12. When the connectors 13, main wiring 22 and retainer clips are in position, as previously described, it will be apparent that all of the essential main wiring components are housed and concealed within the trunk members.

Figure 1:
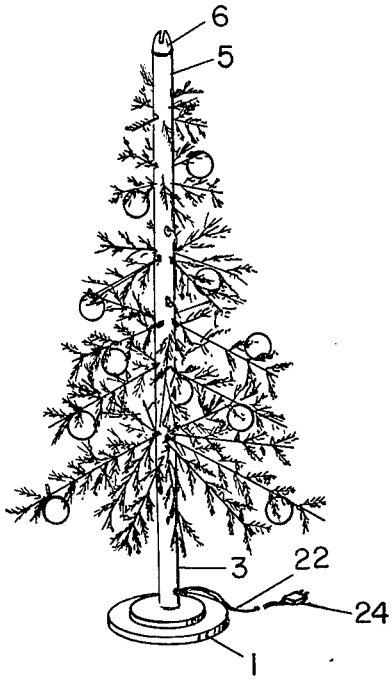

When the artificial tree simulates a Christmas or fir tree, the limbs 10 will, of course, be so arranged in their sockets 8 in cone formation, with the limbs and branches being spaced in the usual manner, as generally illustrated in FIG. 1. Thus, when it is desired to assemble the strings of miniature lights on the branches, individual strings 20 are plugged into each of the female connectors 13 wound or otherwise suitably draped over the limbs and branches adjacent to the respective connectors at the various branch levels, in an obvious manner. In this manner, it is possible to select which areas of the tree are to be lighted, and this also enables the individual strings to be removed and replaced, if necessary, without disturbing the remainder. In addition, the limbs and branches will not be overcrowded and burdened down with wiring, as would occur if the main wiring components were not housed and concealed within the trunk members.

While I have shown and described a preferred embodiment of my invention, it is to be understood that various changes and improvements may be made therein without departing from the scope and spirit of the appended claims.

What is claimed:

1. An artificial tree structure comprising vertically extending hollow tubular trunk members coupled together, a base for said members, said trunk members having a plurality of spaced apertures therein, some of said apertures being oppositely arranged, first socket means in some of said apertures, limb members removably sleeved in said first socket means said first socket means is tubular and flexible and formed with spaced annular flanges thereon for flexibly engaging the periphery of some of said apertures, second electrical socket means having a flat base arranged in others of said apertures, spring clip means having a bowed inwardly extending base portion in apertures opposite those having said second socket means therein and said bowed base engaging and pressing against said flat base for retaining said second socket means in said trunk members, said bowed portion terminates in outwardly and oppositely bent ends for engaging the periphery of said apertures, main double conductor wires extending within said trunk members and connected to said second socket means and to a source of current, double strings of light sockets with bulbs therein and having a male plug thereon, said plugs being adapted to be connected to at least some of said second socket means and arranged on limbs adjacent to said second socket means.

2. The tree structure of claim 1 including an upper and lower trunk members, said lower trunk member having a flared upper end whereby said upper member is removably sleeved therein.

3. The tree structure of claim 1 wherein said second socket means has an enlarged tubular base disposed in said trunk members.

4. The tree structure of claim 3 wherein said enlarged tubular base has a reduced end portion interfitting with said apertures and engageable with the inner wall of said trunk members.

5. The tree structure of claim 4 wherein said reduced end portion has a slotted plate on the outer end thereof whereby the male plug on said strings of light sockets and bulbs are connectable thereto.

* * * * *